US011820572B2

(12) United States Patent
Felber et al.

(10) Patent No.: US 11,820,572 B2
(45) Date of Patent: Nov. 21, 2023

(54) PACKAGING UNIT FOR AT LEAST TWO BUTTON CELLS

(71) Applicants: VARTA Microbattery GmbH, Ellwangen Jagst (DE); VARTA Consumer Batteries GmbH & Co. KGaA, Ellwangen Jagst (DE)

(72) Inventors: Georg Felber, Ellwangen Jagst (DE); Werner Regner, Fichtenau (DE)

(73) Assignees: VARTA Microbattery GmbH, Ellwangen Jagst (DE); VARTA Consumer Batteries GmbH & Co. KGaA, Ellwangen Jagst (DE)

( * ) Notice: Subject to any disclaimer, the term of this patent is extended or adjusted under 35 U.S.C. 154(b) by 0 days.

(21) Appl. No.: 17/859,086

(22) Filed: Jul. 7, 2022

(65) Prior Publication Data

US 2023/0007966 A1 Jan. 12, 2023

(30) Foreign Application Priority Data

Jul. 9, 2021 (EP) ..... 21184720

(51) Int. Cl.

| | |
|---|---|
| ***B65D 75/36*** | (2006.01) |
| ***B65B 11/52*** | (2006.01) |
| ***B65D 75/56*** | (2006.01) |
| ***B65D 85/68*** | (2006.01) |

(52) U.S. Cl.

CPC ..... *B65D 75/367* (2013.01); *B65B 11/52* (2013.01); *B65D 75/566* (2013.01); *B65D 85/68* (2013.01); *B65D 2585/88* (2013.01)

(58) Field of Classification Search

CPC .... B65D 75/367; B65D 75/566; B65D 85/68; B65D 2585/88; B65B 11/52

USPC ..... 206/704

See application file for complete search history.

(56) References Cited

U.S. PATENT DOCUMENTS

| | | | | |
|---|---|---|---|---|
| 5,203,455 | A * | 4/1993 | Hewelt | B65D 75/367 206/460 |
| 9,221,589 | B2 | 12/2015 | Hearing et al. | |
| 2004/0011698 | A1* | 1/2004 | Gaffney | B65D 83/0454 206/704 |
| 2013/0161231 | A1* | 6/2013 | Haering | B65B 5/02 206/704 |
| 2020/0108990 | A1* | 4/2020 | Kuwa | B65D 75/563 |
| 2022/0185566 | A1* | 6/2022 | Renschler | B65D 75/367 |

FOREIGN PATENT DOCUMENTS

| | | |
|---|---|---|
| DE | 20 2019 101 861 U1 | 5/2019 |
| EP | 0 259 574 B1 | 3/1988 |
| EP | 0 284 648 A2 | 10/1988 |
| WO | 2014/187552 A2 | 11/2014 |

* cited by examiner

*Primary Examiner* — Jacob K Ackun

(74) *Attorney, Agent, or Firm* — DLA Piper LLP (US)

(57) ABSTRACT

A packaging unit adapted to contain at least two button cells includes: for each of the button cells, a separate individual compartment that encloses the button cells; the individual compartments are each formed from a separate thermoformed plastics hood and a back plastics film fixed thereto; the individual compartments are configured such that they cannot be opened without tools; a carrier on which the individual compartments are attached; and the individual compartments are spaced apart from one another on the carrier.

12 Claims, 7 Drawing Sheets

PACKAGING UNIT FOR AT LEAST TWO BUTTON CELLS

TECHNICAL FIELD

This disclosure relates to a childproof packaging unit for at least two button cells, particularly, a packaging of the blister card type.

BACKGROUND

The great demand for button cells inevitably also makes the packaging of this mass-produced article an important factor. The packaging must, on the one hand, be economical, but must, on the other hand, also have an appealing appearance to encourage interest in buying. Retail and storage packs of the blister card type are particularly widespread, that is to say a card-shaped visibility packaging, in which the button cells are packaged in plastics-film molded parts.

EP 259574 A2 discloses an example of a retail and storage pack of the blister card type for button cells, in which the packaging is formed on the one hand by a tear-resistant, preferably transparent film made of PVC or polyvinylidene chloride with bowl-shaped embossings to accommodate the button cells and, on the other hand, by a closure foil made of aluminum that is sealed onto this in a smooth-surface manner. To remove a button cell, the latter needs only to be pushed from the outside through the easily tearable aluminum foil.

However, that process can be carried out very easily, possibly even by a small child. To minimize the risk that a small child might unintentionally remove a button cell and swallow it, childproof packaging units that cannot be readily opened by a small child are already known. Such packagings are intended to ensure better safety and in particular to prevent the inadvertent removal of a button cell by a child.

By way of example, DE 20 2019 101 861 U1 discloses a retail and storage pack of the blister card type, in which a plastics molded part is fixed on a carrier formed, for example, by a cardboard blank. The plastics molded part comprises at least one thermoformed recess that forms, together with the carrier, a closed receptacle having a circular-cylindrical basic shape for the cylindrical button cell. Furthermore, the receptacle comprises a side space which is preferably configured as a bulge of the central space and configured such that it cannot be filled by the button cell. In this configuration of the packaging, the side space can be opened by a scissor cut to be able to remove the button cell from the packaging. Tool-free opening is not readily possible, with the result that, in the context of child safety, inadvertent opening by a small child is prevented. Furthermore, the side space is designed such that the button cell is not contacted by the scissors during the scissor cut since the button cell, in terms of its size, does not protrude into the side space. This prevents the button cell from short-circuiting or being damaged.

A further aspect of child safety is the inadvertent swallowing of a button cell, which is associated with the danger of severe burns in the esophagus due to discharge of the button cell and with other serious problems in the gastrointestinal tract.

It could therefore be helpful to provide an improved packaging unit for two or more button cells that accounts for important aspects of child safety, also permits a visually appealing sales presentation of flexible design and, furthermore, is particularly economical in production of the packaging units.

SUMMARY

We provide a packaging unit adapted to contain at least two button cells comprising:

a. for each of the button cells, a separate individual compartment that encloses the button cells;
b. the individual compartments are each formed from a separate thermoformed plastics hood and a back plastics film fixed thereto;
c. the individual compartments are configured such that they cannot be opened without tools;
d. a carrier on which the individual compartments are attached; and
e. the individual compartments are spaced apart from one another on the carrier.

We also provide a method of producing the packaging unit adapted to contain at least two button cells comprising:

a. for each of the button cells, a separate individual compartment that encloses the button cells;
b. the individual compartments are each formed from a separate thermoformed plastics hood and a back plastics film fixed thereto;
c. the individual compartments are configured such that they cannot be opened without tools;
d. a carrier on which the individual compartments are attached; and
e. the individual compartments are spaced apart from one another on the carrier, comprising:
a. providing at least two thermoformed plastics hoods having a respective bowl-shaped recess;
b. introducing a respective button cell into each bowl-shaped recess;
c. closing each plastics hood with a respective plastics film to form an individual compartment; and
d. attaching at least two individual compartments spaced apart from one another on a carrier to form the packaging unit.

DETAILED DESCRIPTION

Figure 1:
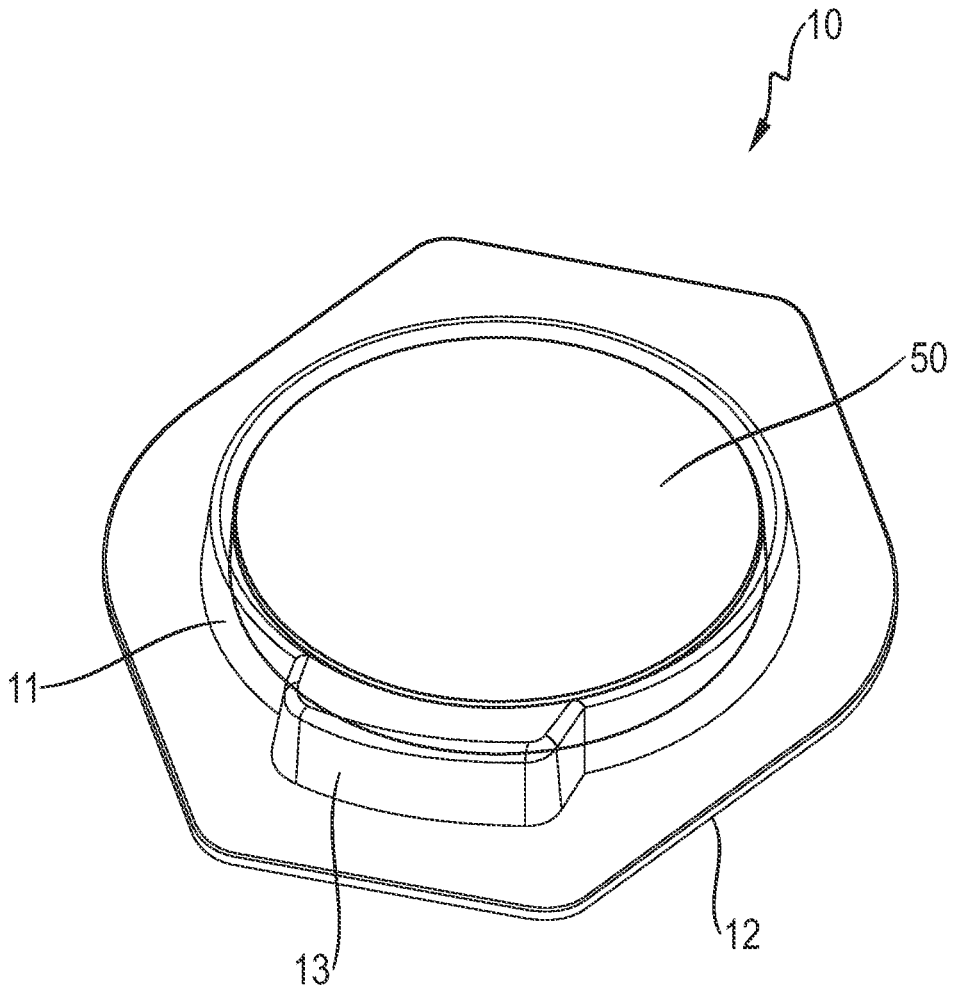
FIG. 1 shows an oblique top view of an individual compartment of a packaging unit comprising an enclosed button cell.

The packaging unit for at least two button cells is characterized by the following features:

a. the packaging unit comprises, for each of the button cells, a separate individual compartment that encloses the button cells;

b. the individual compartments are each formed from a separate thermoformed plastics hood and a back plastics film fixed thereto;
c. the individual compartments are configured such that they cannot be opened without tools;
d. the packaging unit comprises a carrier on which the individual compartments are attached; and
e. the individual compartments are spaced apart from one another on the carrier.

Each button cell of the packaging unit is enclosed in a separate individual compartment, and the individual compartments are spaced apart from one another on the carrier. The packaging unit thus allows a plurality of button cells to be packaged, with each individual button cell being separately encapsulated. The individual compartments are formed by the thermoformed plastics hood and the plastics film fixed thereto such that each button cell is separately firmly closed and encapsulated. Fixing the back plastics film to the plastics hood is configured such that the fixing cannot be readily released, that is to say in particular cannot be pulled off or torn off. Rather, a tool, for example, scissors or a knife is required for the opening of the individual compartment such that a small child generally cannot open the individual compartment or the capsule. What is achieved by the firm encapsulation is that even if the button cell enclosed in the individual compartment were to be swallowed, the button cell would not pose a significant danger since in particular burns due to the button cell in the esophagus or in the gastrointestinal tract cannot occur. The button cell would also remain within the individual compartment in a gastrointestinal passage, and would generally be excreted together with the individual compartment as a single unit again.

In addition, enclosing the button cells within the individual compartments prevents button cells from being associated with sweets or the like such that, in this way, a small child is also already discouraged from swallowing such an individual compartment with the button cell contained therein.

Provision may furthermore be made for the individual compartments to have a certain minimum size which discourages a small child from swallowing them.

A further particular advantage associated with the individual compartments for the individual button cells is of a manufacturing nature. Conventionally, blisters for button cells differ in dependence on the number of button cells in a packaging unit. A packaging unit for two cells required a different blister than one for three, four or five button cells. A dedicated tool was in turn required to manufacture each blister. This is completely different according to our methods. In this example, it is possible to always use the same individual compartments independently of the number of button cells that a packaging unit is intended to comprise. There are differences merely in relation to the number and the arrangement of the individual compartments on the carrier.

What is achieved by the distance between the individual compartments on the carrier is that the button cells can be individually removed from the respective individual compartments in a particularly user-friendly manner, without an adjacent individual compartment being inadvertently damaged, for example.

In general, a button cell is understood to mean an electrochemical energy storage cell with a cylindrical housing, the total height of which is smaller than its diameter.

The button cells of the packaging unit may, in particular, be lithium button cells, which pose a relatively great danger in the event that they are swallowed. However, the button cells may also be energy storage cells of another type, for example, alkaline button cells or silver oxide button cells or zinc-air button cells.

With regard to the attachment of the individual compartments comprising the button cells on the carrier, the packaging unit is characterized, in preferred configurations, by the following feature:

a. to attach the individual compartments on the carrier, provision is made for the back plastics film of the individual compartments to be attached on, in particular adhesively bonded or welded to, the carrier.

By fastening the entire surface of the back plastics film, that is to say the entire rear side of the individual compartment, on the carrier, a secure hold of the individual compartments on the carrier is ensured. The adhesive bonding or welding may be effected in a manner known per se. Thermal sealing which can preferably be carried out with the assistance of a sealing lacquer on the carrier surface is particularly suitable.

The packaging unit is, in particular, a retail and/or storage pack.

In particular, the carrier of the packaging unit is a sheet-like material, as is customary in the field of blister packagings for button cells or batteries in general or for energy storage cells.

In terms of the carrier, the packaging unit is particularly preferably characterized by at least one of the following features:

a. the carrier is a carrier cardboard card; and
b. the carrier comprises at least a proportion of secondary fiberboard, in particular recycled pulp.

The aforementioned features a. and b. are preferably implemented in combination with one another.

The carrier is preferably configured as a cardboard blank. Such cardboard blanks are widely used in blister packagings of this kind. Particular preference is given to using recycled material for the cardboard blank (and also for the production of the individual compartments) to reduce the environmental burden. Provision may in this example be made for at least one side of the cardboard blank to be printed in color and in particular to be provided with information about the product. The printed side is, in particular, the side on which the individual compartments are attached. However, the carrier may, in principle, also be composed of a different material, for example, of a plastic, or may be composed of various materials, for example, of a composite material made up of cardboard and plastic.

The packaging unit is particularly preferably characterized by at least one of the following features:

a. the thermoformed plastics hood forms a bowl-shaped recess having a circular outline to accommodate the button cell;
b. the circular outline of the bowl-shaped recess has, in a part-circle region, a peripheral widened portion;
c. the peripheral widened portion extends over at most 25%, in particular at most 20%, of the circular outline of the bowl-shaped recess; and
d. the thermoformed plastics hood has an encircling flat surface to which the back plastics film is fixed.

Particularly preferably, the aforementioned features a. and b. or a. and b. and c., or very particularly preferably, the aforementioned features a. to d., are implemented with one another in a joint manner.

Due to the circular outline of the bowl-shaped recess of the plastics hood, it is possible for the receptacle to be adapted to the shape and size of the respective button cell in an optimal manner. The circular outline of the receptacle is expediently a little larger than the button cell, with the result that there is a certain amount of play for the insertion, during the packaging process, and for the removal of the button cell.

The peripheral widened portion in accordance with the aforementioned feature b. is provided for user-friendly opening of the packaging by the user to remove the individual button cells while simultaneously providing child safety. The peripheral widened portion or bulge (side space) represents a point of engagement for opening the individual compartment by a scissor cut or a knife cut. Since this opening operation requires a tool, this represents a very advantageous configuration with regard to the child safety of the packaging unit.

The peripheral widened portion is preferably designed in accordance with the aforementioned feature c. such that it only makes up a quarter or less of the circular outline such that the button cell within the individual compartment cannot slide into the widened portion. This may also be further aided by virtue of the widened portion having a smaller height than the rest of the bowl-shaped recess, with the result that sliding of the button cell in the direction of the peripheral widened portion is reliably avoided.

Provision may furthermore be made for at least one scissor-cut marking to be located on the carrier in the region of the peripheral widened portion of the respective individual compartment, the scissor-cut marketing leading through the widened portion and thus providing the user with precise guidance as to how the individual compartment should be opened.

Furthermore, in accordance with the aforementioned feature d., it is very advantageous if the plastics hood forms an encircling flat surface for fixing of the back plastics film. This provides a sealing periphery, as it were, which provides a good engagement surface for the fixing of the back plastics film and thus enables a particularly secure closure or a sealing of the individual compartment.

The bowl-shaped recess preferably has a planar base and an encircling wall. The base is oriented parallel to the carrier. The distance between the base and the carrier defines the height of the receptacle for the button cell.

As has already been mentioned, the receptacle is expediently adapted to the shape and the dimensions of the button cell inserted therein. The receptacle preferably has a diameter which exceeds the diameter of the button cell by a factor of 1.05 to 1.3. In further preferred examples, the receptacle has a height that exceeds the height of the button cell by a factor of 1.01 to 1.2.

Without the peripheral widened portion, which forms a side space of the receptacle, the recess and thus also the receptacle would be of strictly circular-cylindrical configuration. The presence of the side space ensures a deviation from a strictly circular-cylindrical geometry. The shape of the side space is not significant, so the peripheral widened portion can, for example, be curved in a round manner or else have a corner or several corners. However, the side space should advantageously be configured such that it cannot be filled by the button cell. The side space therefore preferably comprises at least one subregion into which the button cell, even if it were to have limited mobility within the widened portion, cannot penetrate, at least not without destroying or deforming the widened portion.

The side space particularly preferably has a smaller height than the rest of the receptacle, in particular a smaller height than the button cell. This can make the scissor cut easier. In addition, this is a particularly simple way to effectively prevent the button cell from penetrating into the side space.

In a particularly preferred configuration of the individual compartments, the following feature is provided:

a. the material of the plastics hood has a greater thickness than the material of the back plastics film.

What is achieved by the different thicknesses of the materials for the plastics hood and for the back plastics film is that the back film is more flexible than the front plastics hood. Furthermore, the greater flexibility of the back plastics film makes it possible to fix or fasten the back plastics film of the individual compartment on the carrier in a particularly stable manner. In this context, the material of the plastics hood is preferably selected such that a stable shaping for the receptacle of the button cell is achieved.

With regard to the material for the individual compartments, the packaging unit is particularly preferably characterized by at least one, and preferably both, of the following features a. and b.:

a. the material of the plastics hood has a film thickness of 250-350 μm, in particular 300 μm; and
b. the material of the back plastics film has a film thickness of 150-250 μm, in particular 200 μm.

In principle, the material in particular for the plastics hood may be composed of any thermoformable plastic, for example, of polyvinyl chloride (PVC) or polyethylene, in particular low-density polyethylene (PE-LD).

Particularly preferably, polyethylene terephthalate (PET) is used as the material for the plastics hood and preferably also for the material of the plastics film. When using PET both for the plastics hood and for the back plastics film, it is possible to achieve particularly firm closing of the individual compartments, and therefore the encapsulation of the button cells is particularly secure, in particular also with regard to possible swallowing of an individual compartment comprising an enclosed button cell. It is particularly preferred if the PET film for the plastics hood has the film thickness, which has already been mentioned above, of 250-350 μm, in particular 300 μm, and the PET material of the back plastics film has a film thickness of 150-250 μm, in particular 200 μm.

It is particularly preferred if the material of the plastics hood and preferably also the material of the back plastics film are each transparent. This measure makes it possible to produce particularly appealing visual appearances and packaging units of flexible design since the visual appearance of the packaging unit is then influenced substantially by the design of the carrier.

The carrier, that is to say, for example, the cardboard blank, may additionally be provided with a reinforcing film, for example, a film composed of polyethylene terephthalate, of polyolefin and/or of PVC. The film may have a thickness of 5 μm to 50 μm, for example. By way of the reinforcing film, the carrier is designed in a tear-resistant manner as an additional safety measure. In this example, the carrier and in particular the cardboard blank may be covered with the reinforcing film in a full-area manner or only in certain regions. By way of example, the reinforcing film may cover only that region of the carrier which is fitted with the individual compartments for the button cells. In addition or as an alternative, the rear side of the carrier or that side of the carrier facing away from the individual cells may also be covered with the reinforcing film, and/or the peripheries of the carrier may be protected and reinforced by the reinforcing film.

By way of example, the reinforcing film may have a tensile strength of approximately 1000 kg/cm$^2$ to 3500 kg/cm$^2$ in accordance with standard ASTM D882, preferably 1200 kg/cm$^2$ to 3300 kg/cm$^2$ in accordance with standard ASTM D882.

The packaging unit is particularly preferably characterized by the following additional feature:

a. the individual compartments have a diamond-shaped outline with rounded edges.

The diamond-shaped shape or the diamond-shaped outline with rounded edges in the individual compartments permits a very flexible design of the packaging unit. The individual compartments can, for example, be arranged next to one another or in a grid pattern or in a circular pattern on the carrier. The diamond shape in this example permits a very space-saving arrangement on the carrier. It is thus, for example, possible to provide two or four or five individual compartments per packaging unit in a very appealing manner. A double pack with 2×5 button cells is also possible, for example. Other arrangements and numbers of individual compartments on a carrier are also possible.

Furthermore, perforations may be provided on the carrier to be able to detach individual portions of the carrier in a simple manner. By way of example, this makes it possible to provide portions comprising a respective individual compartment for separation.

Overall, the packaging of the button cells in the form of individual compartments permits very flexible use in the packaging process and great flexibility in the design of the packaging unit with regard to the number of button cells per packaging unit and also with regard to the visual appearance and the geometrical arrangement of the individual compartments on the carrier. The individual compartments can be produced in large quantities in a very simple manner and then be fastened essentially in any desired number and arrangement on the carrier.

The shape and the small size of the thermoformed plastics hood makes it possible to achieve optimal use of the plastic during the thermoforming operation, and so unnecessary plastics waste (skeletal waste) is largely avoided.

In addition, the use of, for example, PET and in particular of 100% PET for the individual compartments is very environmentally friendly since it can be supplied to a potential recycling process in an easy and simple manner.

The packaging unit can thus be designed in a very environmentally friendly manner overall since it is possible for both the carrier to be produced from recycled and/or recyclable material and the individual compartments to be produced from recycled and/or recyclable material. The carrier is, for example, an environmentally friendly carrier cardboard card that may be composed, for example, of at least 90% recycled secondary fiberboard. For example, 80% recycled PET material may be used as plastics material for the plastics hood and the back plastics film. In addition, the requirement for plastics material is significantly lower than in conventional packagings of the blister card type, in which plastic is generally provided over the entire front surface of the carrier.

Overall, the packaging unit can therefore be produced in a particularly environmentally friendly manner, in particular also due to the low requirement for plastics.

We further provide a method of producing a packaging unit for at least two button cells. This method, by which an above-described packaging unit can be produced, comprises the following steps:

a. at least two thermoformed plastics hoods having a respective bowl-shaped recess are provided;
b. a respective button cell is introduced into each bowl-shaped recess;
c. each plastics hood is closed with a respective plastics film to form an individual compartment; and
d. at least two individual compartments are attached on a carrier to form the packaging unit, wherein the individual compartments are spaced apart from one another.

With respect to the closing of the plastics hood, the method is characterized in particular by at least one of the following features a. to c.:

a. the closing of the plastics hood with the plastics film is effected by welding or adhesive bonding;
b. the closing of the plastics hood with the plastics film is effected by thermal sealing; and
c. the thermal sealing for closing the plastics hood is effected with control of the parameters time, pressure and temperature.

The welding or adhesive bonding of the back plastics film to the plastics hood achieves a secure closure of the individual compartments, which cannot be readily opened without tools. This ensures that the individual compartments form a hermetically sealed space for the button cells, which, for example, also does not open in the esophagus or in the gastrointestinal tract in inadvertent swallowing of the individual compartments.

To ensure that the individual compartments cannot be opened without tools, it is particularly preferred that the back plastics film is fixed to the separate thermoformed plastics hood by welding in each of the individual compartments, and that the back film and the plastics hood are each manufactured from a film material that, like the reinforcing film, preferably has a tensile strength of approximately 1000 kg/cm$^2$ to 3500 kg/cm$^2$ in accordance with standard ASTM D882, preferably a tensile strength of 1200 kg/cm$^2$ to 3300 kg/cm$^2$ in accordance with standard ASTM D882.

Particularly preferably, thermal sealing is performed for closing the individual compartments. By control of the parameters time, pressure and temperature, this can advantageously be integrated into the production process for the packaging units and be controlled in a highly satisfactory manner.

Particularly preferably, the method is furthermore characterized by at least one of the following additional features, preferably by a combination of the features a. and b.:

a. prior to attachment of the individual compartments, the carrier is provided with a sealing lacquer; and
b. the attachment of the individual compartments on the carrier is effected by thermal sealing.

The sealing lacquer, in particular in preparation for a thermal sealing operation, makes it possible for the attachment of the individual compartments on the carrier to be further consolidated and secured. The use of a sealing lacquer also permits a particularly favorable production process.

Further features and advantages emerge from the following description of preferred examples in conjunction with the drawings. The individual features may each be implemented individually or in combination with one another.

FIG. 1 shows a separate individual compartment 10 for a packaging unit, wherein two or more such individual compartments 10 are attached on a carrier. The individual compartment 10 encases a button cell 50, for example, a lithium button cell. In this example, the individual compartment 10 is formed by a thermoformed plastics hood 11 having a bowl-shaped recess and a back plastics film 12 fixed thereto. The bowl-shaped recess exhibits a largely circular outline for accommodating the button cell. Furthermore, a peripheral widened portion 13 is provided in the bowl-shaped recess. The dimensions of the peripheral widened portion 13 are selected in this example such that the button cell 50 enclosed within the individual compartment 10 cannot slide into the peripheral widened portion 13 or at least cannot slide completely therein.

The individual compartment 10 or the thermoformed plastics hood 11 and the back plastics film 12 which form the individual compartment 10 are preferably manufactured from a plastics material, preferably from PET. It is preferred that the plastics hood 11 is manufactured from a more dimensionally stable material, in particular from a thicker plastics film than the back plastics film. Due to the use of PET to PET in the sealing of the individual compartments, a particularly childproof encapsulation of the button cells is obtained, which also does not dissolve or come apart in inadvertent swallowing of the individual compartments.

Particularly preferably, the material of the plastics hood 11 is PET having a thickness of 300 μm. In particular, it is also possible here to use a recycled material, for example, an 80% recycled material. The back plastics film 12 is preferably likewise composed of PET (a film thickness of 200 μm being particularly preferred), possibly also of a recycled material, preferably an 80% recycled material.

To open the individual compartment 10, provision is made for a scissor cut or a knife cut to be carried out by the user in the region of the peripheral widened portion 13 of the plastics hood 11 such that an engagement possibility for opening the individual compartment is created and the button cell 50 can be removed. This opening of the individual compartment 10 is thus possible only with the aid of a tool.

The bowl-shaped recess of the thermoformed plastics hood 11 is expediently adapted to the size of the button cells to be packaged. For example, a bowl-shaped recess having a diameter of 20.9 mm may be used for button cells with a diameter of up to 20 mm. For larger or smaller button cells, the diameter of the bowl-shaped recess can be adapted accordingly.

Figure 2:
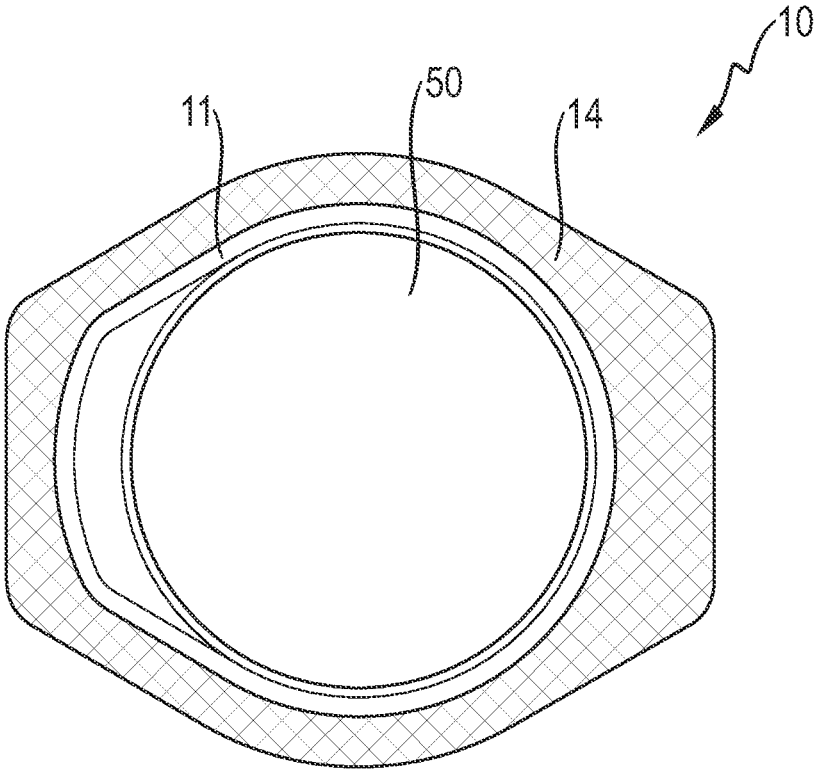
FIG. 2 shows a top view of an individual compartment of the packaging unit with the sealing surface in hatched form.

FIG. 2 shows a top view of the individual compartment 10 comprising the button cell 50 enclosed therein. The bowl-shaped recess of the plastics hood 11 is surrounded by an encircling flat surface 14 that forms a sealing surface for the back plastics film fixed thereto. The thermoformed plastics hood 11 and the back plastics film are firmly connected to one another in the region of the sealing surface 14, with the result that the button cell 50 located within the individual compartment 10 is hermetically sealed towards the outside. The button cell 50 is thus securely encapsulated in the individual compartment 10, and so there is generally no danger in the event of inadvertent swallowing of the individual compartment 10.

The sealing surface 14 defines the outer outline of the individual compartment 10, wherein, in this preferred example, the outline is of diamond-shaped configuration with rounded edges. This shape permits various, and in particular also space-saving, arrangements of multiple individual compartments 10 on a carrier. Other shapes of the individual compartments may also be provided.

Figure 3C:
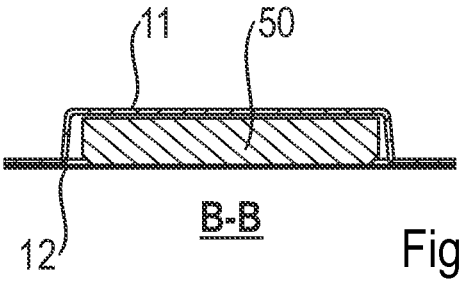
FIGS. 3A-3C show a top view of an individual compartment of the packaging unit with two sectional views.
Figure 3B:
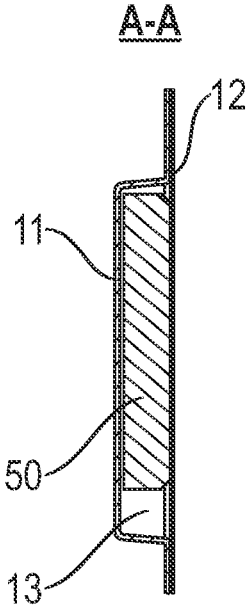
Figure 3A:
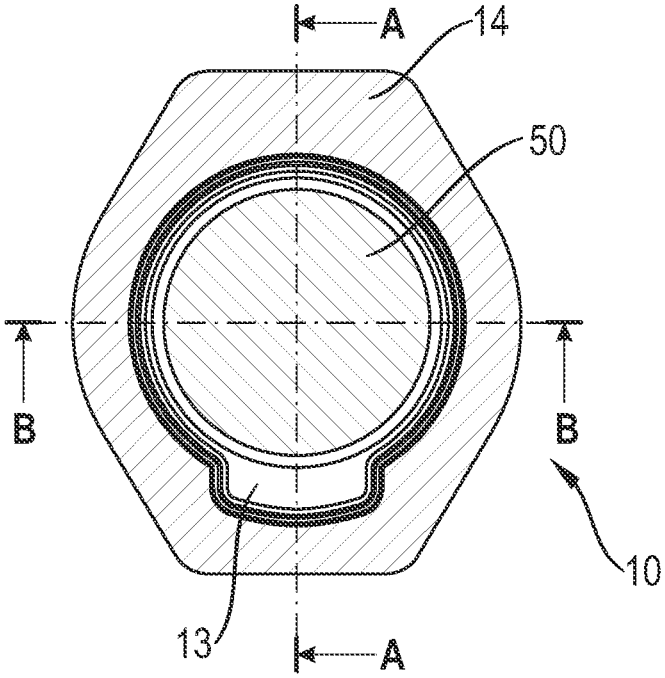

FIG. 3A shows a further top view of an individual compartment 10, wherein the corresponding sections along section lines A-A (FIG. 3B) and B-B (FIG. 3C) are additionally shown.

Section B-B (FIG. 3C) illustrates that the button cell 50 lies within the receptacle of the individual compartment 10 with a certain amount of play. However, the button cell cannot slide into the peripheral widened portion 13 of the bowl-shaped recess, as illustrated by section A-A (FIG. 3B), since the widened portion extends only over less than a quarter of the circumference of the bowl-shaped recess.

Figure 4:
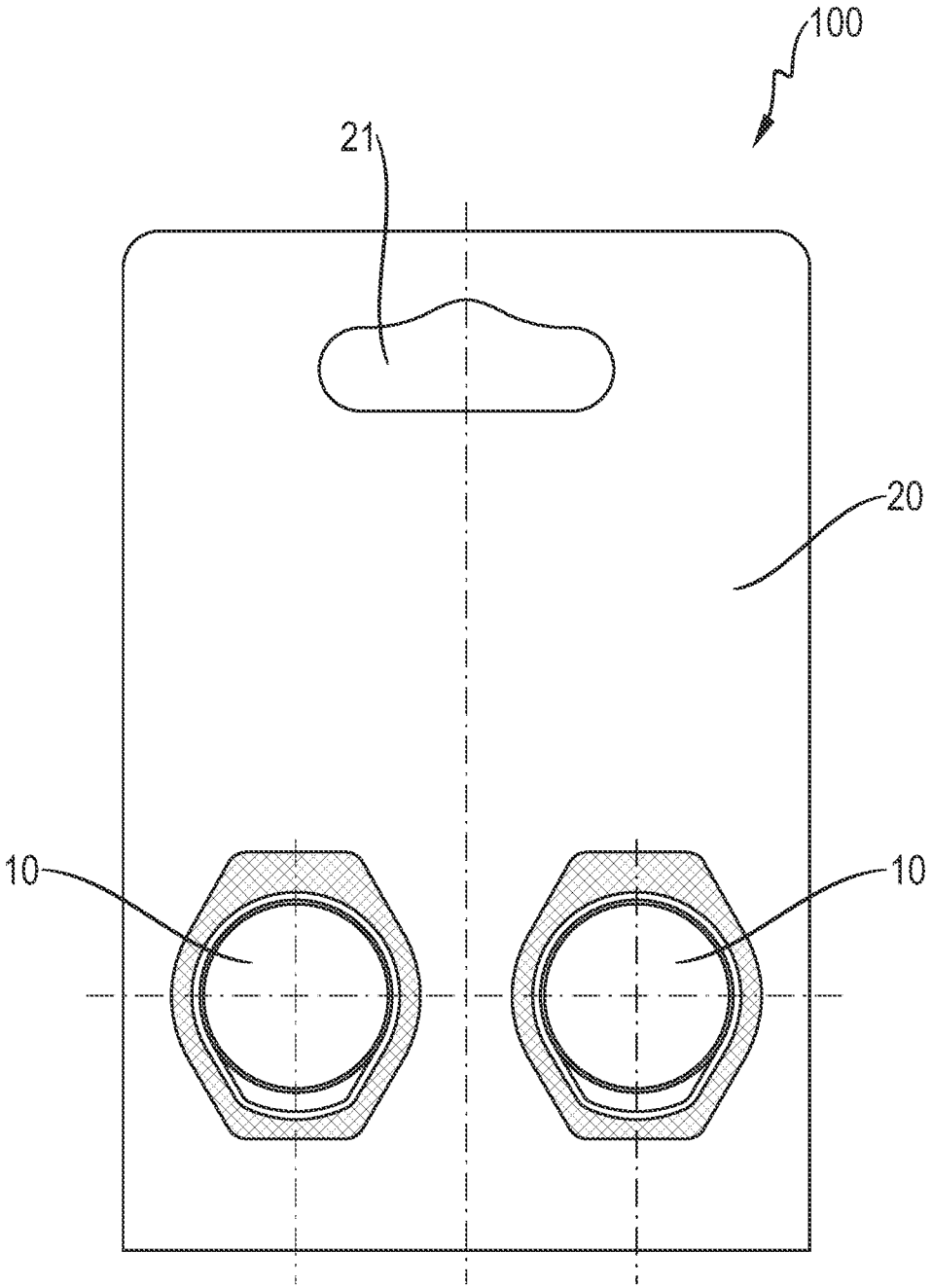
FIG. 4 shows a top view of a packaging unit comprising two separate individual compartments.

FIG. 4 illustrates a packaging unit 100 comprising two individual compartments 10 fastened thereon and that each enclose a button cell. Particular features of the individual compartments 10 emerge from the description above. The individual compartments 10 are, by way of their back plastics film, adhesively bonded or welded onto a carrier 20, in particular a cardboard blank. Thermal sealing is particularly suitable for this. To improve the attachment of the individual compartments 10 on the carrier 20, the carrier may be provided with a sealing lacquer, in particular in the region of the individual compartments 10 to be applied. A hanging eye 21 is expediently punched into the upper region of the carrier 20 such that the packaging unit 100 can be hung from a sales stand.

The carrier 20 is a rectangular carrier. The carrier 20 can be provided with various colorful and graphical designs.

The packaging unit 100 can be used, in particular, as a retail pack but, for example, also as a storage pack.

Figure 5:
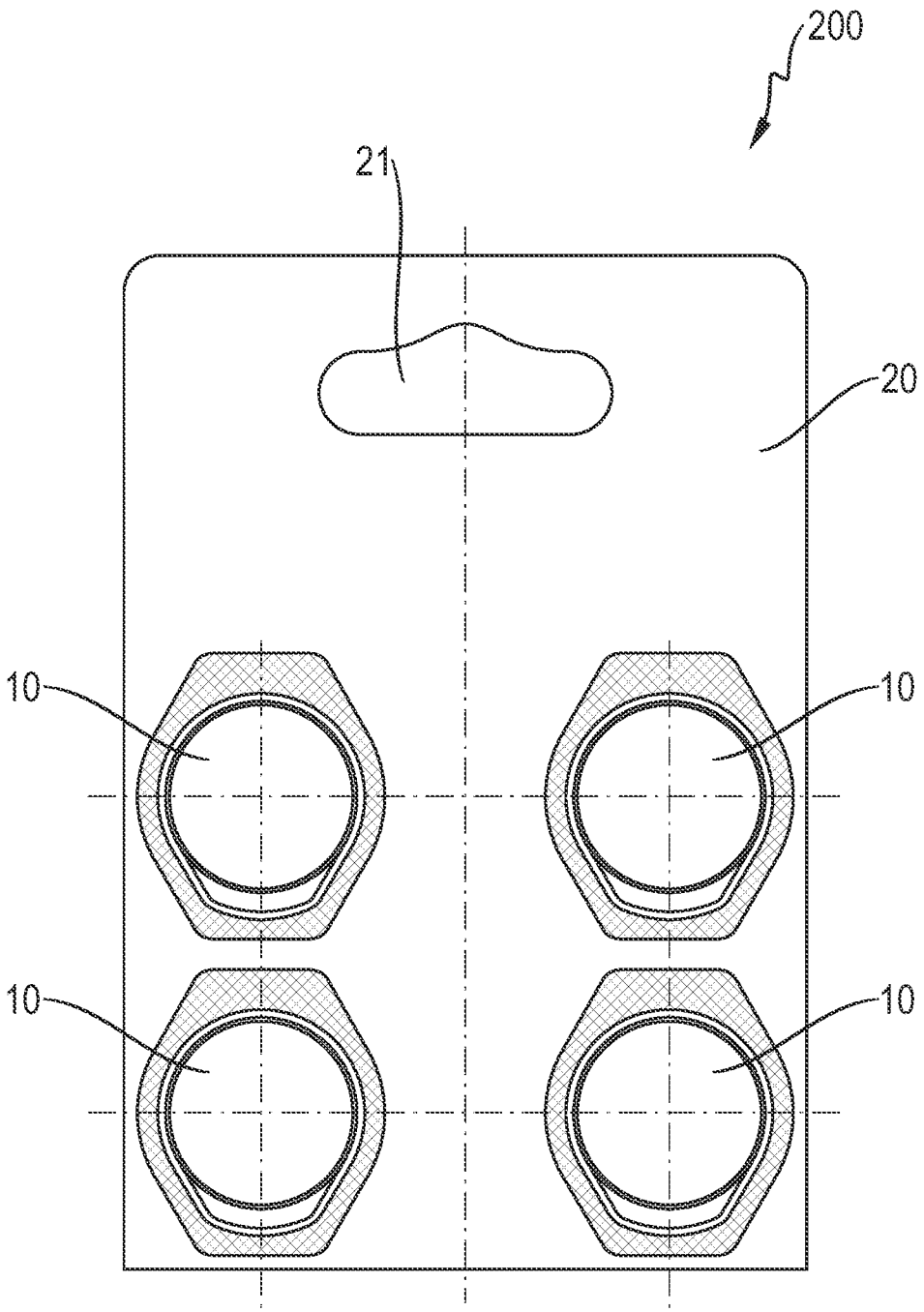
FIG. 5 shows a top view of a packaging unit comprising four separate individual compartments.

FIG. 5 shows a further packaging unit 200 in which a total of four individual compartments 10, each comprising an enclosed button cell, are provided. The individual compartments 10 are each arranged in two rows of two individual compartments. Similarly to the packaging unit 100 from FIG. 4, a hanging eye 21 is also provided here in the rectangular carrier 20.

Figure 6:
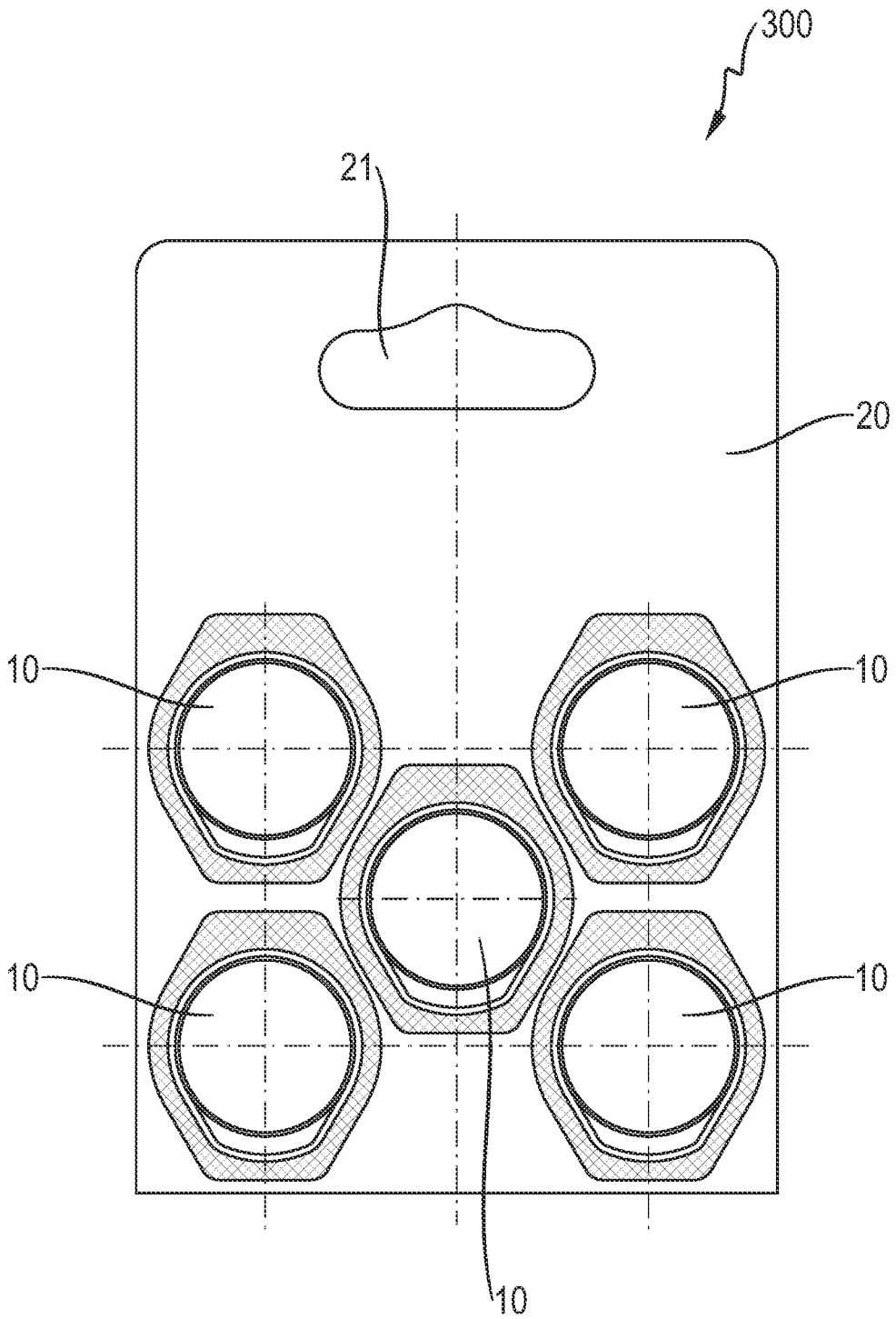
FIG. 6 shows a top view of a packaging unit comprising five separate individual compartments.

FIG. 6 shows a further packaging unit 300. In this example, a total of five individual compartments are attached on the rectangular carrier 20. The individual compartments 10 are fastened on the carrier 20 in a space-saving manner, but at a distance from one another in each example.

Figure 7:
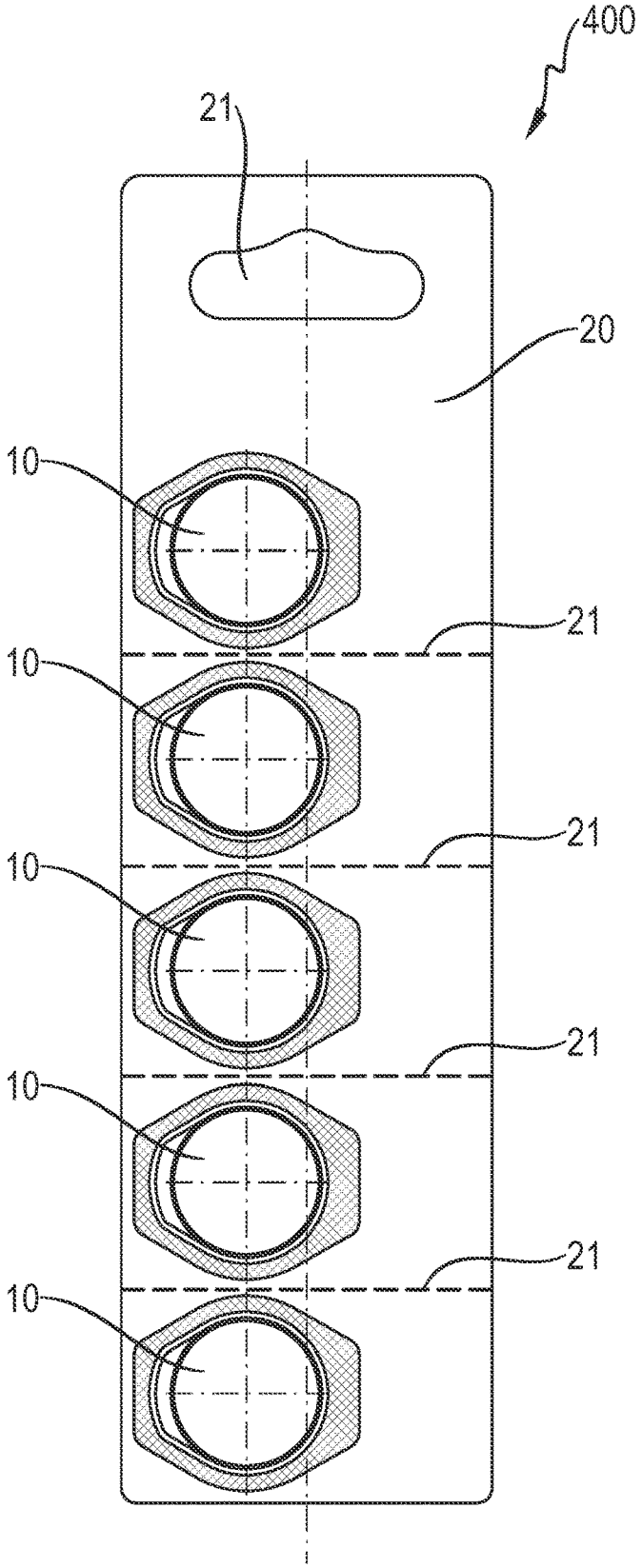
FIG. 7 shows a top view of a packaging unit comprising five separate individual compartments arranged in a row.

FIG. 7 shows a further packaging unit 400. Also, a total of five individual compartments 10 comprising a respective button cell are attached on the carrier 20. In this example, the individual compartments 10 are arranged in a row from top to bottom. Between the separate individual compartments 10, a respective perforation 22 is provided on the carrier, with the result that the corresponding portions of the carrier comprising a respective individual compartment or comprising a button cell can be detached. A design of the packaging unit 400 with the possibility of tearing off portions comprising a respective button cell is also referred to as tear-off.

A possible scissor-cut marking which may run through the peripheral widened portion 13 of the individual compartments 10 is not illustrated in the figures. Such scissor-cut markings can indicate to the user the possibility of opening the individual compartments 10 by way of a scissor cut in the region of the widened portion 13.

During the manufacture of the individual compartments and the packaging unit, closing the individual compartments is preferably effected by thermal sealing, which is controlled by three sealing parameters (time, pressure and temperature). In this way, very secure welding of the plastics hood to the back plastics film can be achieved. The individual compartments themselves may also be applied to the carrier by thermal sealing, the carrier in this example preferably being provided with a sealing lacquer on the front side, the sealing lacquer ensuring that the individual compartments have very good adhesion.

A particular advantage of the packaging units is that the production can be carried out in an automated manner. In particular, a packaging machine with automated dispensing of button cells and automatic intermediate and shipment packaging is used.

The invention claimed is:

1. A packaging unit adapted to contain at least two button cells comprising:

a. for each of the button cells, a separate individual compartment that encloses the button cells;

b. the individual compartments are each formed from a separate thermoformed plastics hood and a back plastics film fixed thereto;

c. the individual compartments are configured such that they cannot be opened without tools;

d. a carrier on which the individual compartments are attached; and e. the individual compartments are spaced apart from one another on the carrier.

2. The packaging unit according to claim 1, wherein, to attach the individual compartments on the carrier, the back plastics film of the individual compartments is attached on or adhesively bonded or welded to the carrier.

3. The packaging unit according to claim 1, wherein:

a. the carrier is a carrier cardboard card, and b. the carrier comprises at least a proportion of secondary fiberboard or recycled pulp.

4. The packaging unit according to claim 1, wherein at least one of:

a. the thermoformed plastics hood forms a bowl-shaped recess having a circular outline to accommodate the button cell, b. the circular outline of the bowl-shaped recess has, in a part-circle region, a peripheral widened portion, c. the peripheral widened portion extends over at most 25% of the circular outline of the bowl-shaped recess, and d. the thermoformed plastics hood has an encircling flat surface to which the back plastics film is fixed.

5. The packaging unit according to claim 1, wherein the material of the plastics hood has a greater thickness than the material of the back plastics film.

6. The packaging unit according to claim 1, wherein at least one of:

a. the material of the plastics hood has a film thickness of 250-350 μm, and b. the material of the back plastics film has a film thickness of 150-250 μm.

7. The packaging unit according to claim 1, wherein at least one of:

a. the material of the plastics hood and the material of the plastics film is polyethylene terephthalate (PET), and b. the material of the plastics hood and the material of the back plastics film are transparent.

8. The packaging unit according to claim 1, wherein the individual compartments have a diamond-shaped outline with rounded edges.

9. The packaging unit according claim 1, wherein the packaging unit comprises two or four or five individual compartments for a respective button cell.

10. A method of producing the packaging unit adapted to contain for at least two button cells according to claim 1, comprising:

a. providing at least two thermoformed plastics hoods having a respective bowl-shaped recess;

b. introducing a respective button cell into each bowl-shaped recess;

c. closing each plastics hood with a respective plastics film to form an individual compartment; and d. attaching at least two individual compartments spaced apart from one another on a carrier to form the packaging unit.

11. The method according to claim 10, wherein at least one of:

a. the closing of the plastics hood with the plastics film is effected by welding or adhesive bonding, b. the closing of the plastics hood with the plastics film is effected by thermal sealing, and c. the thermal sealing for closing the plastics hood is effected with control of parameters time, pressure and temperature.

12. The method according to claim 10, wherein at least one of:

a. prior to attachment of the individual compartments, the carrier is provided with a sealing lacquer, and b. the attachment of the individual compartments on the carrier is effected by thermal sealing.

* * * * *